US005192067A

United States Patent [19]

Saito

[11] Patent Number: 5,192,067

[45] Date of Patent: Mar. 9, 1993

[54] PAPER FEED FOR PAGE PRINTER

[75] Inventor: Akihiro Saito, Shizuoka, Japan

[73] Assignee: Tokyo Electric Co., Ltd., Tokyo, Japan

[21] Appl. No.: 850,231

[22] Filed: Mar. 10, 1992

Related U.S. Application Data

[63] Continuation of Ser. No. 578,725, Sep. 6, 1990, abandoned.

[30] Foreign Application Priority Data

Sep. 8, 1989 [JP] Japan ..... 1-234080

[51] Int. Cl.[5] ..... B65H 5/00; G03G 21/00

[52] U.S. Cl. ..... 271/10; 271/116; 271/226; 271/264; 355/317

[58] Field of Search ..... 271/10, 114, 116, 119, 271/226, 264; 355/317

[56] References Cited

U.S. PATENT DOCUMENTS 4,569,582 2/1986 Hyltoft .
4,605,215 8/1986 Hyltoft .
4,798,373 1/1989 Hyltoft .
4,893,150 1/1990 Yamada ..... 355/317 X
4,967,239 10/1990 Sakakura .

FOREIGN PATENT DOCUMENTS 0199376 10/1986 European Pat. Off. .
0314536 5/1989 European Pat. Off. .
57-150269 9/1982 Japan .
221878 12/1983 Japan ..... 355/317
86522 5/1984 Japan ..... 271/10
59-140466 11/1984 Japan .
59-225977 12/1984 Japan .
124447 6/1986 Japan ..... 271/10

*Primary Examiner*—Robert P. Olszewski
*Assistant Examiner*—Boris Milef
*Attorney, Agent, or Firm*—Frishauf, Holtz, Goodman & Woodward

[57] ABSTRACT

A paper feeder comprises a paper pick up mechanism, feeding rollers for receiving the paper supplied from the pick up mechanism and transporting the paper to an image transfer position for a toner image formed on a photosensitive drum and rotated along with the photosensitive drum, a stepping motor for driving the photosensitive drum and the feeding rollers, and drive pulse generator for sequentially generating drive pulses to be supplied to the stepping motor. The paper feeder further comprises a paper feeding controller for controlling the operation of the paper pick up mechanism in accordance with the number of the drive pulses generated from the drive pulse generator.

7 Claims, 5 Drawing Sheets

PAPER FEED FOR PAGE PRINTER

This application is a continuation of application Ser. No. 578,725, filed Sep. 6, 1990, now abandoned.

BACKGROUND OF THE INVENTION

1. Field of the Invention

The present invention relates to a paper feeder for an electrophotographic image forming apparatus in which a toner image is formed on a image carrier and rotates along with the image carrier, in particular to a paper feeder which supplies a sheet of paper to an image transfer position at which the toner image is transferred from the image carrier to the paper sheet.

2. Description of the Related Art

Conventionally, a laser printer contains a photosensitive drum which rotates in one direction at a time of printing. During the rotation, the photosensitive drum is sequentially subjected to processes of an electrifying charger, a laser scanner, a developing unit, a transferring charger, cleaning unit and a discharge unit, which are arranged in that order along the peripheral surface of the photosensitive drum. The surface of the photosensitive drum is electrified by the high voltage applied from the electrifying charger and is scanned by a laser beam irradiated from the laser scanner. The laser beam exposes the charged surface selectively, in accordance with print data for one page, and forms an electrostatic latent image on the photosensitive drum. The developing unit supplies toner to the drum surface and makes the electrostatic latent image visible as a toner image comprising toner adhered to the drum surface in accordance with the electrostatic latent image. The transferring charger charges a sheet of paper by applying high voltage to the paper supplied through a feeding path for the toner image, thereby transferring the toner image on the photosensitive drum to the paper by means of electrostatic suction force. The paper is ejected through a fixing unit which is provided for fixing the toner image onto the paper by means of heat and pressure. After transferring the toner image, the cleaning unit removes unused toner from the drum surface, and the discharge unit removes the electricity from the photosensitive drum surface.

Generally, the above mentioned laser printer uses a paper cassette, containing pre-cut sheets and attached to the printer. The papers are extracted one by one from the paper cassette by means of a pick up mechanism and are carried to the exhaust port of the printer through the transferring charger and the fixing unit by means of plural sets of feeding rollers. The feeding rollers begin to move at the same time as the photosensitive when each printing run starts, and the rotation of the rollers is maintained at a fixed speed throughout the processes. The pick up mechanism starts to move while the toner image is being formed, in response to the rotation of the photosensitive drum, and the timing of the start is fixed so that the paper is opposed to the toner image formed on the photosensitive drum when the toner image passes through the position of the transferring charger.

Incidentally, the above-mentioned processing sections and others are controlled by an electronic control circuit including CPU, the operation sequence of which is determined by a software program. The starting and stopping of the pick up mechanism in the conventional art is dependent on the time management of the CPU.

However, the conventional laser printer as mentioned above has a disadvantage in that the timing for supplying the paper to the image transfer position is not accurate. This is because of a variation of the overhead due to a modification of the software program, or a variation of the start timing of the pick up mechanism due to an interrupt handling which has no relationship to the control of the pick up mechanism. In such a case, it is not possible to transfer the toner image within the desired range of the paper. This problem becomes more serious in proportion to the speed of the printing operation.

SUMMARY OF THE INVENTION

An object of the present invention is to provide a paper feeder in which the accuracy of the paper feed timing can be improved.

The object can be attained by a paper feeder which comprises a paper pick up section, a feeding mechanism for receiving the paper supplied from the pick up section and transporting the paper to an image transfer position for a toner image formed on an image carrier and rotated along with the image carrier, a stepping motor for driving the image carrier and the feeding mechanism, a motor driver for generating drive pulses to be supplied to the stepping motor, and a feed controller for counting the drive pulse generated from the motor driver and actuating the paper pick up section when it is detected that the count has reached a preset value.

In such a paper feeder, the timing for actuating the paper pick up section is determined by the rotation angle of the stepping motor. Since the rotation angle of the stepping motor corresponds to that of the image carrier on which the toner image is formed, the variation in the actuation timing can be reduced in comparison with a case where the time elapse after the start of each printing run is measured by a control circuit for totally controlling the printing. Therefore, even if the print speed of the printer is increased, it is possible to transfer the toner image safely within the range of each paper sheet.

DETAILED DESCRIPTION OF THE PREFERRED EMBODIMENTS

Figure 1:
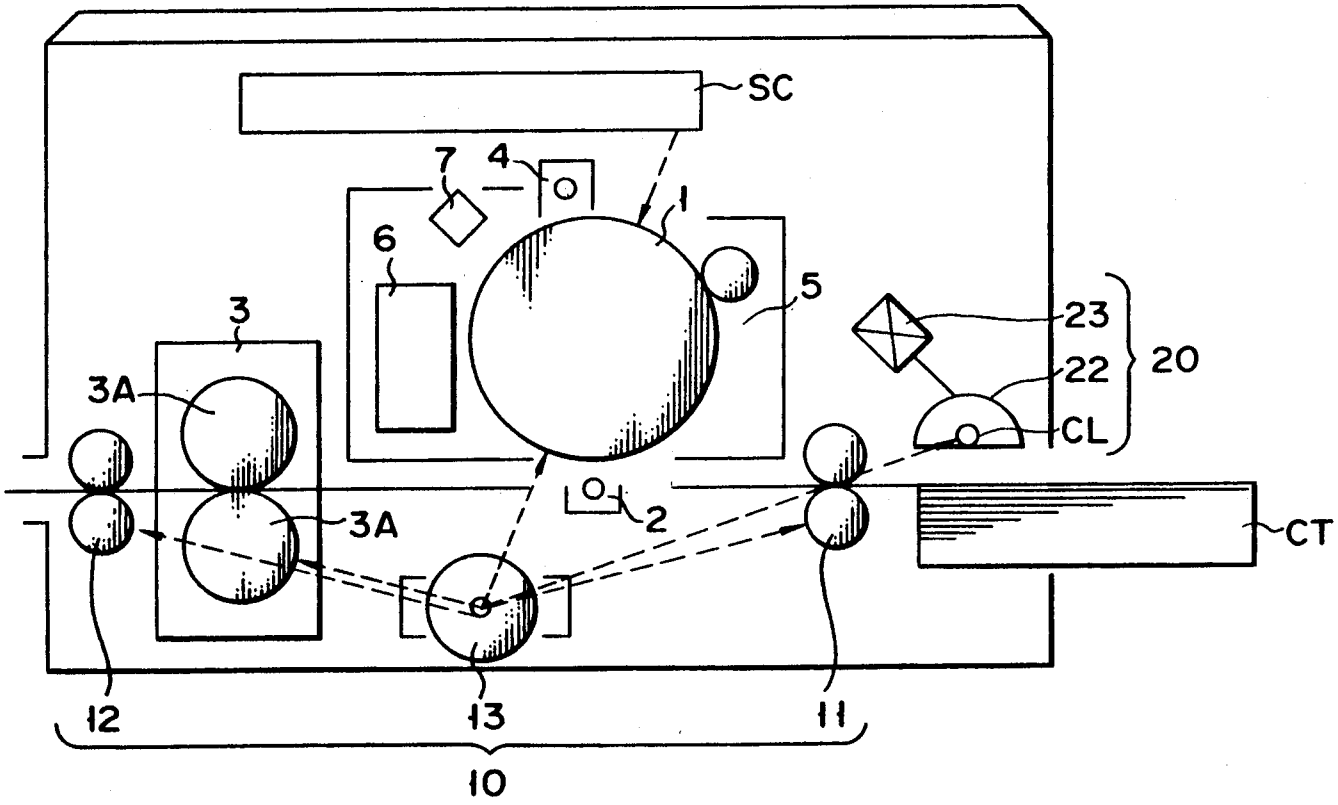
FIG. 1 is a schematic diagram for showing the internal constitution of a laser printer according to one embodiment of the present invention.

Now, a laser printer according to one embodiment of the present invention will be described with reference to FIGS. 1 to 4. FIG. 1 shows an internal constitution of the laser printer. The internal structure is approximately the same as that in the conventional art, and the laser printer contains a photosensitive drum 1 which rotates to one direction at the time of printing. During the rotation, the photosensitive drum 1 is sequentially subjected to processes of an electrifying charger 4, a laser scanner SC, a developing unit 5, a transferring charger 2, a cleaning unit, 6, and a discharge unit 7, which are arranged in that order along the peripheral surface of the photosensitive drum 1. The surface of the photosensitive drum 1 is electrified by high voltage applied from the charger 4, and is scanned by a laser beam irradiated from the laser scanner SC. The laser beam exposes the charged surface selectively in accordance with the printing data for one page to form an electrostatic latent image on the photosensitive drum 1. The developing unit 5 supplies toner to the drum surface, and makes the electrostatic latent image visible as the toner image comprising the toner adhered to the drum surface in accordance with the electrostatic latent image. The transferring charger 2 applies high voltage to the paper which is supplied through a feeding path for each toner image, so as to charge the paper, thereby transferring the toner image on the photosensitive drum 1 onto the paper by means of an electrostatic suction force. The paper is ejected through a fixing unit 3 which is provided on the feeding path to fix the toner image on the paper by heat and pressure. After transferring the toner image, the cleaning unit removes unused toner from the photosensitive drum surface, and the discharge unit 6 discharges the electricity from the drum surface.

A paper cassette CT is attached to the printer and contains pre-cut sheets. The papers are extracted one by one from the paper cassette CT by means of a pick up mechanism 20, and each paper picked up is carried to the exhaust port of the printer by means of plural sets of feeding rollers 11 through the transferring charger 2 and the fixing unit 3. The feeding rollers 11 rotate together with the photosensitive drum 1 in accordance with the starting of each printing operation, wherein the rotation is maintained at a fixed speed over all processes. The pick up mechanism 20 starts while the toner image is being formed in accordance with the rotation of the photosensitive drum 1, so that the toner image is transferred from the photosensitive drum 1 to the paper at the position of the transferring charger 2.

The pick up mechanism 20 comprises a solenoid 23, an one way clutch CL, and a semicircular shaped roller 22. The semicircular shaped roller 22 is coupled to a stepping motor 13 through the one way clutch CL. The stepping motor 13 is coupled to drive the photosensitive drum 1, the feeding roller 11, and the fixing roller 3A of the fixing unit 3. In order to realize high speed printing, the stepping motor 13 is subjected to a slow up control after starting and a slow down control before the printing finishes. In the slow up control, the motor speed is accelerate up to a fixed level in a predetermined number of initial steps. In the slow down control, the motor speed is reduced from the fixed level to zero in the predetermined number of final steps. The one way clutch CL transmits the driving force of the stepping motor 13 to the semicircular shaped roller 22 when the solenoid 23 turns ON and, conversely, the one way clutch CL breaks the driving force transmitted from the stepping motor 13 to the semicircular shaped roller 22 when the solenoid 23 turns OFF. The semicircular shaped roller 22 rotates in response to the rotation of the stepping motor 13 to pick up the paper stored in the paper cassette CT.

Figure 2:
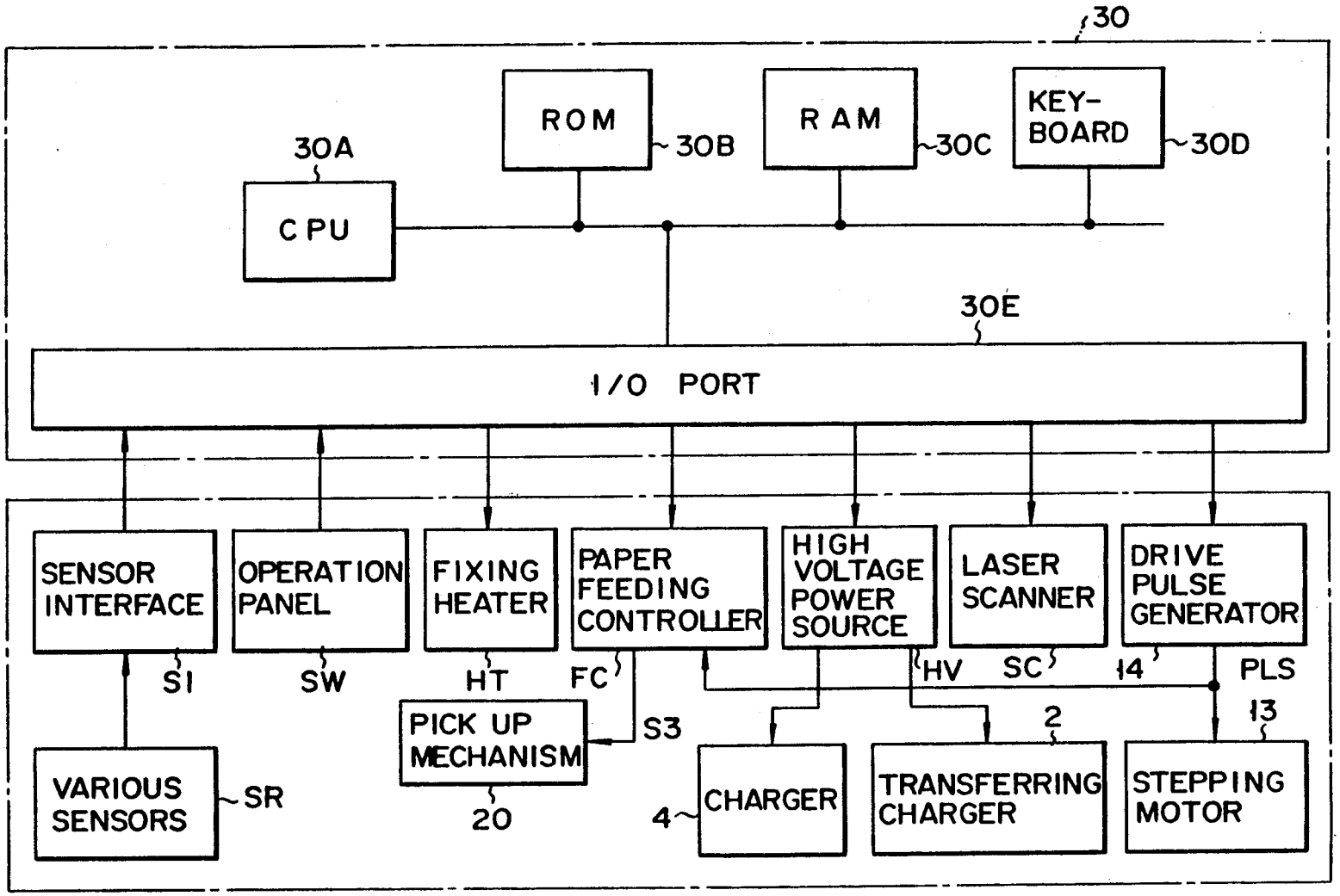
FIG. 2 is a diagram for showing a control circuit of the laser printer of FIG. 1.

FIG. 2 shows a control circuit of the laser printer. The control circuit comprises a main control circuit 30 and peripheral circuits. The main control circuit 30 comprises CPU 30A, ROM 30B, RAM 30C, key board 30D, and I/O port 30E, which are coupled to each other. ROM 30B stores a control program and the fixed data of CPU 30A, and RAM 30C is used for storing the input and output data of CPU 30B temporarily. CPU 30A achieves each kind of calculation and control in accordance with the control program stored in ROM 30B, in order to totally control the printing. I/O port 30E is used for transmitting the data between CPU 30A and the peripheral circuits. As is conventionally known, a sensor interface SI, an operation panel SW, a fixing heater HT, a high voltage power source HV, a laser scanner SC, and a drive pulse generator 14, and so on are coupled to I/O port 30E. Various sensors SR are coupled to the sensor interface SI, and the stepping motor 13 is coupled to the drive pulse generator 14.

In the present embodiment, a paper feeding controller FC is further coupled to I/O port 30E, the drive pulse generator 14 is coupled to the paper feeding controller FC, and the pick up mechanism 20 is coupled to the paper feeding controller FC.

Figure 3:
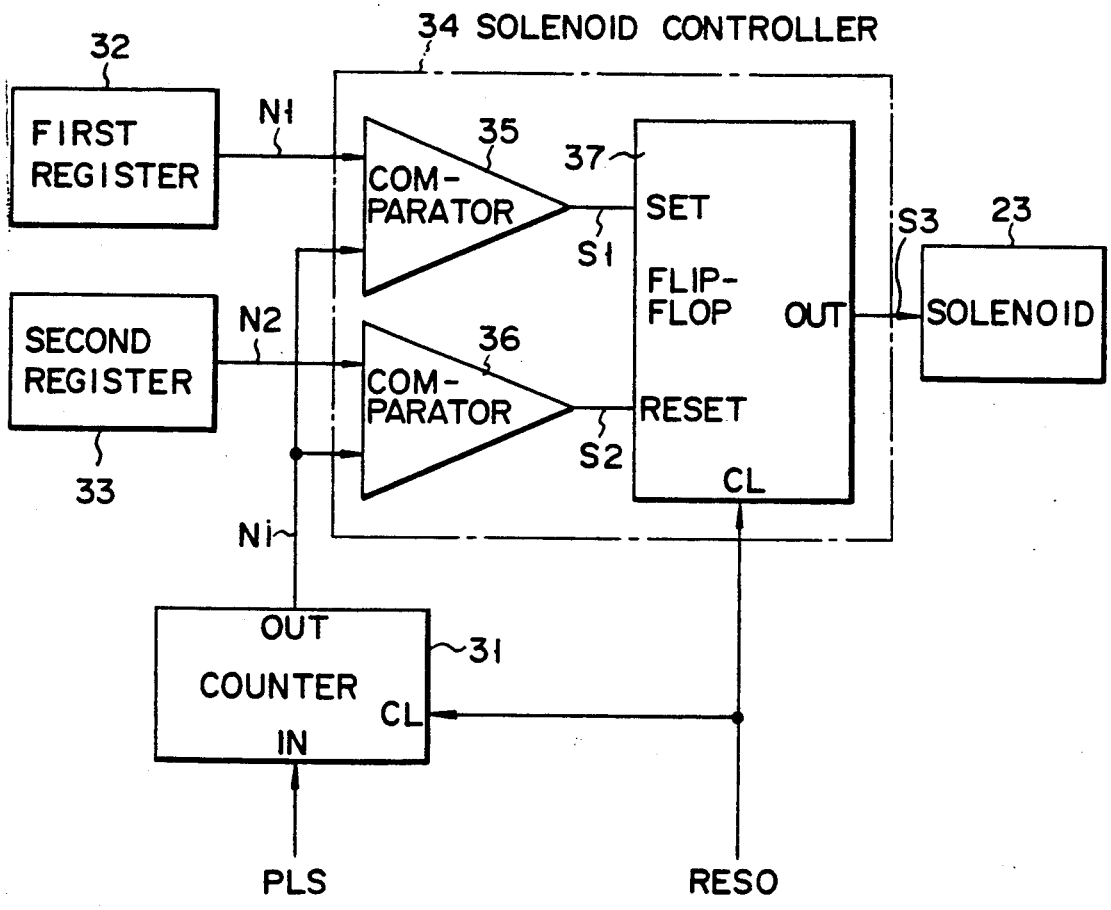
FIG. 3 is a detailed illustration for showing the constitution of the paper feeding controller shown in FIG. 2.

FIG. 3 shows the constitution of the paper feeding controller FC. The paper feeding controller FC comprises a counter 31, a first register 32, a second register 33, and a solenoid controller 34.

A counter 31 counts the number of pulses PLS supplied from the pulse generator 14 to the stepping motor 13 in response to the driving start. Since the pulses PLS are generated from a reference clock signal of the main control circuit 30, the operation of the counter 31 is not influenced due to the interrupt handing of the CPU 30A.

The first register 32 stores a preset value N1 which represents the start timing of the one way clutch CL, that is, the timing for turning the solenoid 23 ON. The second register 33 stores a preset value N2 which represents the stop timing of the one way clutch CL, that is, the timing for turning the solenoid 23 OFF. The preset value N1 equals to a difference between the number of steps of the stepping motor 13 required for extracting a sheet of paper from the paper cassette CT and supplying the front end of a desired area of the paper sheet to the transferring charger 2 and the number of steps of the stepping motor 13 required for forming a toner image on the photosensitive drum 1 and supplying the front end of the toner image to the transferring charger 2. As for the determination of the preset value N1, the response of the one way clutch CL is taken into consideration. Further, it is preferable that the preset value N1 is larger than the number of steps of the stepping motor 13 required for the slow up control. On the other hand, the preset value N2 equals to the number of stepping of the stepping motor 13 required for the paper sheet to be extracted from the paper cassette CT and completely received by the pair of feeding rollers 11 nearest to the paper cassette CT. Both preset values N and N2 can be changed depending on the size of the toner image, for example.

The solenoid controller 34 comprises a comparator 35 for continuously comparing the preset value N1 stored in the first register 32 and the count Ni of the counter 31, a comparator 36 for continuously comparing the preset value N2 stored in the second register 33 and the count Ni, and a flip-flop circuit 37. The flip-flop circuit 37 is set in response to the starting timing signal S1 supplied from the comparator 35 when the count Ni is larger than the preset value N1, and reset in response to the stop timing signal S2 supplied from the comparator 36 when the count Ni is larger than the preset value N2. The flip-flop circuit 37 of his set in response to the signal S1 and reset in response to the signal S2. The control signal S3 supplied from the flip-flop circuit 37 to the solenoid 23 is set to high level when the flip-flop circuit 37 is set, and set to low level when the flip-flop circuit 37 is reset.

The solenoid 23 turns ON when the control signal S3 is high level and turns OFF when the control signal S3 is low level. Accordingly, the one way clutch CL is started and stopped accurately on the basis of the driving pulses PLS for the stepping motor 13. The counter 31 and flip-flop circuit 37 are initialized by a reset signal RESO which is supplied from the CPU 30A through the I/O port 30E. Although the reset signal RESO is generated under the control of CPU 30A, this has no direct relationship to the deviation in the start or stop timing of the one way clutch CL.

Figure 4:
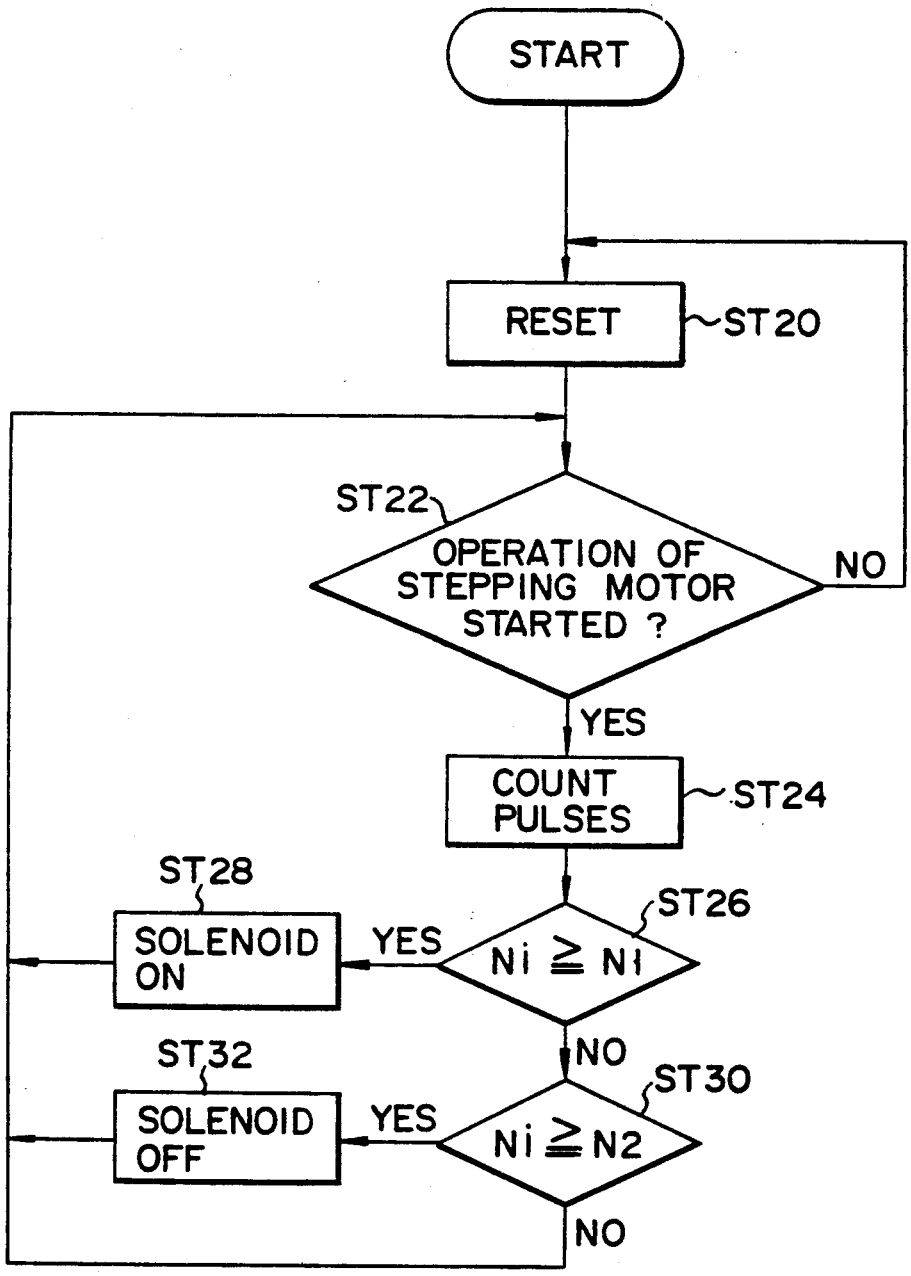
FIG. 4 is a flowchart for showing the paper feeding operation of the laser printer.

The paper feeding operation of the printer will be described with reference to FIG. 4. FIG. 4 shows a feed control for each sheet of paper stored in the paper cassette CT.

When the feeding operation is stated, the counter 31 and the flip-flop circuit 37 is initialized (ST20). In this initializing, the count Ni is set to zero. Then, it is confirmed that the operation of the stepping motor 13 has been allowed and started (ST22), and the counter 31 counts the pulses PLS supplied to the stepping motor 13 (ST24). When the count Ni is detected to be smaller than the preset values N1 and N2 stored respectively in the first and second registers 32 and 33 (ST26 and ST30), it is confirmed again that the operation of the stepping motor is still allowed (ST22) and the counting of the pulses PLS is continued (ST24).

In a case where an instruction for aborting the printing operation is input to the CPU 30A, it is detected that the operation of the stepping motor is inhibited (ST22), and the reset signal (RES0) is supplied to counter 31 and flip-flop circuit 37 (ST20).

When it is detected that the count Ni is equal or larger than the preset value N1 (ST26), the start timing signal S1 is generated from comparator 35. The flip-flop circuit 37 is set in response to the signal S1, and makes the solenoid 23 ON (ST28). The one way clutch CL is operated to rotate semicircular roller 22. A sheet of paper is extracted from the paper cassette CT in accordance with the rotation of the roller 22.

After the front end of the paper sheet has reached the pair feeding roller pair 11 nearest to the cassette CT, it is detected that the count Ni is equal or larger than preset value N2 (ST30), and the stop timing signal S2 is generated from comparator 36. The flip-flop circuit 37 is reset in response to the signal S2, and makes the solenoid 23 OFF. The one way clutch CL is released from rotating the semicircular roller 22. At this time, the pick up mechanism 20 completes the paper extracting operation.

According to the present embodiment described above, the paper feeding controller FC determines the start and stop timings of the one way clutch CL on the basis of the step angles of the stepping motor 13 or the driving pulses PLS supplied to the stepping motor 13. Since this determination is not performed by the main control 30, it is possible to prevent the conventional disadvantage such as deviation of the paper feed timing due to the interrupt handling of CPU 30A which has no relationship to the paper feed control. Since the rotation angle of the photosensitive drum and the moving distance of the paper are obtained by counting the pulses PLS supplied to the stepping motor 13, the accuracy of the paper feed timing is improved rather than in the case where the paper feed operation is controlled on the bases of the time elapse from the start of driving the photosensitive drum 1 and feeding rollers 11. Further, the rotation speed of the photosensitive drum 1 and the moving speed of the paper are determined by intervals between the pulses PLS. Therefore, the period for driving the semicircular roller 22 can properly be set, with respect to these speeds. Since the paper feed operation is accurate and stable, it is possible to realize a reliable and high quality printing.

Since the paper feeding controller FC is a hardware logic circuit formed of the counter 31, comparators 35 and 36, and flip-flop circuit 33, a reliable operation is assured. Such a reliable operation does not depend on a program change, etc. of the main control circuit 30.

Figure 5:
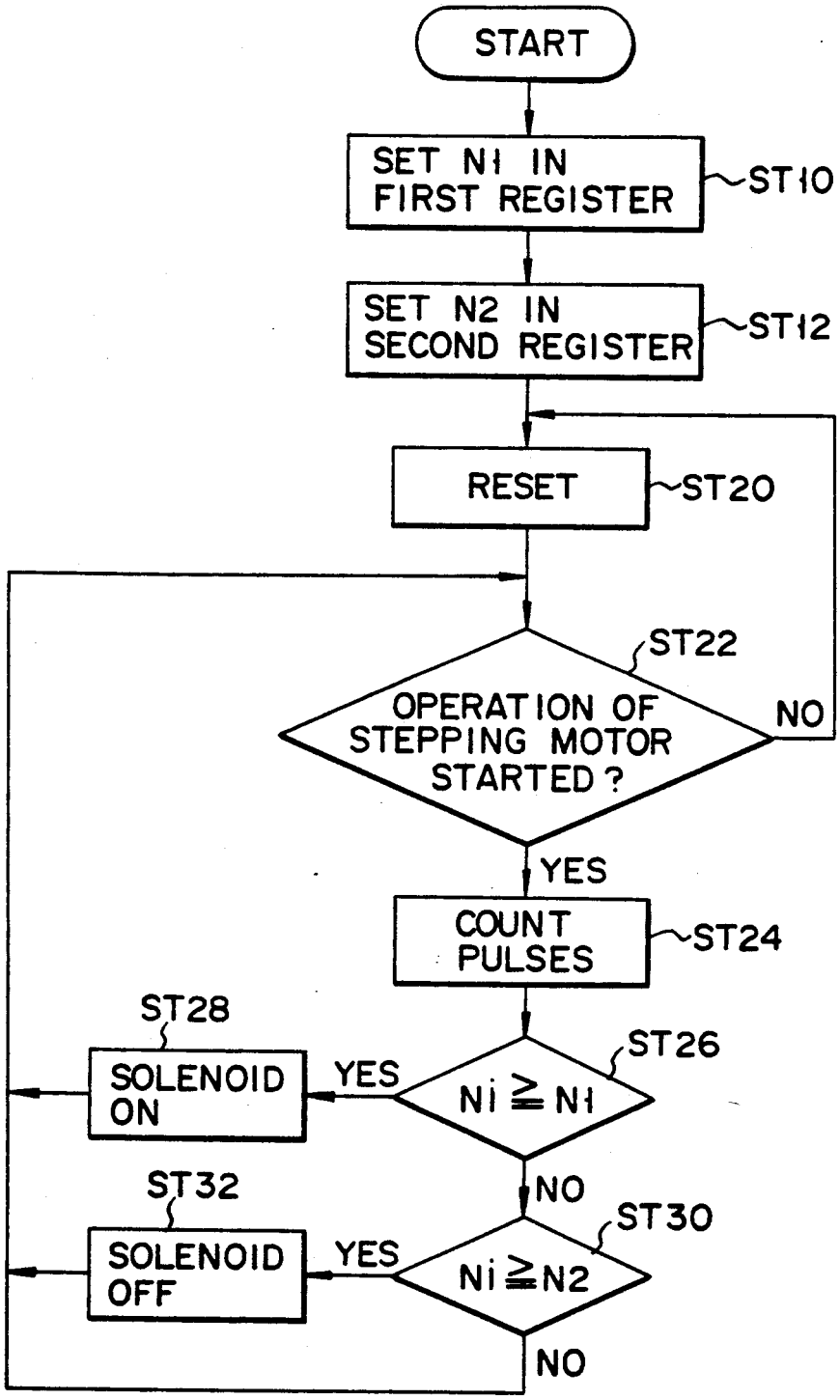
FIG. 5 is a flowchart for showing the paper feeding operation of a modified laser printer.

In the above embodiment, the paper feed control is performed with a use of the registers 32 and 33 containing the values N1 and N2. These values N1 and N2 can be set in the registers 32 and 33 by means of CPU 30A in printing preparation steps ST10 and ST12, as shown in FIG. 5.

The paper feeding controller FC can be variously modified, although it is required to control the start and stop timings of the one way clutch CL (or solenoid 23) on the basis of step angles of the stepping motor 13, independently of the time management for the total control of the printer. For example, it is possible to use a CPU, ROM, RAM, and the like of circuit 30 if a highest priority interrupting process is set to perform an operation wherein the number of steps of the stepping motor 13 is counted and the count is compared with the preset values N1 and N2, within a fixed period.

What is claimed is:

1. A paper feeder comprising:
- a paper pick up section for supplying paper;
- an image carrier;
- a feeding mechanism for receiving paper supplied from said pick up section and transporting the paper to an image transfer position for a toner image formed on said image carrier and rotated along with said image carrier;
- a stepping motor for driving said image carrier and said feeding mechanism;
- motor driving means for sequentially generating drive pulses to be supplied to said stepping motor; and
- control means for controlling the operation of said paper pick up section in accordance with the number of the drive pulses generated from said motor driving means;
- said control means including:
  - counting means for counting the drive pulses generated from the motor driving means;
  - detecting means for detecting that the count of said counting means has reached at least one preset value; and
  - determining means for determining an actuating period of said pick up section in accordance with an output signal of said detecting means.

2. A paper feeder according to claim 1, wherein said detecting means includes:
- first detecting circuit means for detecting the count of said counting means has reached a first preset value; and
- second detecting circuit means for detecting that the count of said counting means has reached a second preset value.

3. A paper feeder according to claim 2, wherein said determining means includes actuating means for actuating said pick up section when it is detected that the count has reached said first preset value and for deactuating said pick up section when it is detected that the count has reached the second preset value.

4. A paper feeder according to claim 3, wherein:

said first detecting circuit means includes a register for storing the first preset value and a comparator for comparing the count with the stored first preset value; and said second detecting circuit means includes a register for storing the second preset value and a comparator for comparing the count with said stored second preset value.

5. A paper feeder according to claim 4, wherein said actuating means includes a flip-flop circuit which is set in response to an output signal from the comparator of said first detecting circuit means and which is reset in response to an output signal from the comparator of said second detecting circuit means.

6. A paper feeder according to claim 5, wherein said pick up section includes a semicircular roller, a clutch connected between said stepping motor and said semicircular roller, and a solenoid for actuating said clutch during the period in which said flip-flop circuit is set.

7. A paper feeder according to claim 1, wherein said control means further includes initializing means for initializing said counting means for each paper feed.

* * * * *